US008707585B2

(12) United States Patent
Dow et al.

(10) Patent No.: US 8,707,585 B2
(45) Date of Patent: Apr. 29, 2014

(54) REMOVABLE FOOTWEAR CLEAT WITH CUSHIONING

(75) Inventors: Jeffrey M. Dow, Paxton, MA (US); Craig Rubino, Brighton, MA (US); Armand J. Savoie, Gardner, MA (US)

(73) Assignee: Cleats LLC, Marlborough, MA (US)

( * ) Notice: Subject to any disclaimer, the term of this patent is extended or adjusted under 35 U.S.C. 154(b) by 0 days.

(21) Appl. No.: 13/545,128

(22) Filed: Jul. 10, 2012

(65) Prior Publication Data

US 2012/0272549 A1 Nov. 1, 2012

Related U.S. Application Data

(62) Division of application No. 12/949,010, filed on Nov. 18, 2010, now Pat. No. 8,225,536, which is a division of application No. 11/754,509, filed on May 29, 2007, now abandoned.

(60) Provisional application No. 60/809,323, filed on May 30, 2006, provisional application No. 60/823,396, filed on Aug. 24, 2006.

(51) Int. Cl.
*A43C 15/16* (2006.01)

(52) U.S. Cl.
USPC ..... 36/67 R; 36/67 D; 36/134

(58) Field of Classification Search
USPC ..... 36/67 R, 67 D, 134
See application file for complete search history.

(56) References Cited

U.S. PATENT DOCUMENTS

| | | | | |
|---|---|---|---|---|
| 2,491,596 | A | 12/1949 | Zaleski et al. | 36/59 |
| 2,911,738 | A | 11/1959 | Clerke | 36/2.5 |
| 4,240,215 | A | 12/1980 | Broussard | 36/67 D |
| 4,466,205 | A | 8/1984 | Corbari | 36/134 |
| 4,470,207 | A | 9/1984 | Bente | 36/134 |
| 4,492,047 | A | 1/1985 | Arff | 36/134 |
| 4,644,672 | A | 2/1987 | Dassler et al. | 36/134 |
| 5,259,129 | A | 11/1993 | Deacon et al. | 36/127 |
| 5,361,518 | A | 11/1994 | Sussmann et al. | 36/134 |

(Continued)

FOREIGN PATENT DOCUMENTS

| | | | |
|---|---|---|---|
| CN | 1056230 | 11/1991 | A43B 21/02 |
| DE | 2810363 | 9/1979 | A43B 13/26 |

(Continued)

OTHER PUBLICATIONS

International Searching Authority, International Search Report—International Application No. PCT/US2007/069853 dated Oct. 16, 2007, together with the Written Opinion of the International Searching Authority, 11 pages.

(Continued)

*Primary Examiner* — Marie Patterson

(74) *Attorney, Agent, or Firm* — Sunstein Kann Murphy & Timbers LLP

(57) ABSTRACT

A removable cleat for footwear. The cleat includes a disc with opposing faces. A shoe coupling element is attached to one face of the disc. The other disc face supports a cushioning layer. Traction elements are supported by the cushioning layer. When a user steps on a surface wearing a shoe outfitted with these cleats, the resilience of the cushioning layer at once both lessens the impact of the traction elements on the ground surface and lessens the reaction force on the user's foot transmitted through the shoe's outsole. The user's comfort is thereby enhanced.

13 Claims, 11 Drawing Sheets

(56) References Cited

U.S. PATENT DOCUMENTS

| | | | | |
|---|---|---|---|---|
| 5,377,431 | A * | 1/1995 | Walker et al. | 36/134 |
| 5,505,012 | A * | 4/1996 | Walker et al. | 36/134 |
| D371,895 | S | 7/1996 | McMullin | D2/962 |
| 5,794,367 | A | 8/1998 | Carroll | 36/134 |
| 5,887,371 | A | 3/1999 | Curley, Jr. | 36/127 |
| 5,996,260 | A | 12/1999 | MacNeill | 36/134 |
| 6,009,640 | A | 1/2000 | Deacon et al. | 36/127 |
| 6,023,860 | A | 2/2000 | McMullin | 36/127 |
| 6,041,526 | A | 3/2000 | Collins | 36/127 |
| 6,052,923 | A | 4/2000 | McMullin | 36/127 |
| 6,094,843 | A | 8/2000 | Curley, Jr. | 36/127 |
| D432,770 | S | 10/2000 | Breault et al. | D2/962 |
| 6,138,386 | A | 10/2000 | Singer et al. | 36/127 |
| 6,167,641 | B1 | 1/2001 | McMullin | 36/127 |
| 6,209,230 | B1 | 4/2001 | Curley, Jr. | 36/157 |
| 6,305,104 | B1 | 10/2001 | McMullin | 36/127 |
| 6,327,797 | B1 | 12/2001 | Deacon et al. | 36/127 |
| 6,354,021 | B1 | 3/2002 | Deacon et al. | 36/127 |
| 6,381,878 | B1 | 5/2002 | Kennedy, III et al. | 36/134 |
| 6,530,162 | B1 | 3/2003 | Carroll | 36/134 |
| 6,675,505 | B2 | 1/2004 | Terashima | 36/134 |
| 6,775,931 | B2 * | 8/2004 | Hokkirigawa et al. | 36/134 |
| 6,823,613 | B2 | 11/2004 | Kelly et al. | 36/134 |
| 6,834,445 | B2 * | 12/2004 | McMullin | 36/127 |
| 6,834,446 | B2 | 12/2004 | McMullin | 36/134 |
| 6,904,707 | B2 | 6/2005 | McMullin | 36/127 |
| D509,050 | S | 9/2005 | Savoie | D2/962 |
| 7,040,043 | B2 | 5/2006 | McMullin | 36/127 |
| 7,134,226 | B2 | 11/2006 | Robinson, Jr. et al. | 36/134 |
| 7,600,333 | B2 | 10/2009 | Robinson, Jr. et al. | 36/134 |
| 7,685,745 | B2 * | 3/2010 | Kuhtz et al. | 36/67 R |
| 8,225,536 | B2 * | 7/2012 | Dow et al. | 36/134 |
| 8,316,562 | B2 * | 11/2012 | Locke et al. | 36/67 R |
| 2001/0011429 | A1 * | 8/2001 | Peabody | 36/134 |
| 2002/0078603 | A1 | 6/2002 | Schmitt, Jr. | 36/134 |
| 2003/0172556 | A1 | 9/2003 | Terashima | 36/134 |
| 2007/0240337 | A1 | 10/2007 | Belluto | 36/134 |
| 2007/0251128 | A1 | 11/2007 | Yen | 36/134 |
| 2008/0072459 | A1 * | 3/2008 | Robinson et al. | 36/134 |
| 2008/0072460 | A1 * | 3/2008 | Robinson et al. | 36/134 |

FOREIGN PATENT DOCUMENTS

| | | | |
|---|---|---|---|
| DE | 20211809 | 12/2003 | A43C 15/02 |
| DE | 20 2005 018 431 | 3/2006 | A43C 15/16 |
| DE | 202007006860 | 10/2008 | A43B 5/00 |
| FR | 2804583 | 8/2001 | A43C 15/16 |
| GB | 2098457 | 11/1982 | A43C 15/16 |
| WO | WO 01/56420 | 8/2001 | A43C 15/16 |
| WO | WO 2007/059757 | 5/2007 | A43C 15/16 |
| WO | WO 2007/143443 | 12/2007 | A43C 15/16 |
| WO | WO 2010/065620 | 6/2010 | A43C 15/16 |

OTHER PUBLICATIONS

International Searching Authority, International Search Report—International Application No. PCT/US2009/066387 dated Mar. 23, 2010, together with the Written Opinion of the International Searching Authority, 9 pages.

Chinese Patent Office, Notification of the First Office Action—Application No. 200780020238.9, dated Sep. 20, 2010 (5 pages).

Chinese Patent Office, English Translation of Text of the First Office Action (7 pages).

Notification of Transmittal of the International Search Report and the Written Opinion of the International Searching Authority, or the Declaration; May 29, 2007.

* cited by examiner

REMOVABLE FOOTWEAR CLEAT WITH CUSHIONING

This application is a divisional of U.S. patent application Ser. No. 12/949,010, entitled "Removable Footwear Cleat with Cushioning," filed Nov. 18, 2010, which is a divisional of U.S. patent application Ser. No. 11/754,509, filed May 29, 2007. This application also claims priority from U.S. provisional patent application, Ser. No. 60/809,323, filed May 30, 2006, and from U.S. provisional patent application, Ser. No. 60/823,396, filed Aug. 24, 2006. All of the above applications are incorporated herein by reference.

TECHNICAL FIELD

The present invention relates to traction cleats mounted on the bottom of footwear, in particular, on the bottom of athletic footwear.

BACKGROUND

Athletic shoe cleats, in particular golf cleats, have been subject to changing designs in recent years, to attempt to provide users with a variety of advantages. For many years, a cleat took a simple form of a spike, usually made of metal, attached to the bottom of a shoe. Because such spikes could damage non-athletic surfaces and some athletic surfaces as well, variations have been made from the simple form. For example, UK Patent Application 2,098,457 to Perks discloses surrounding a spike element of a cleat with soft material, to decrease damage done to surfaces.

SUMMARY OF THE INVENTION

In an embodiment of the invention, a removable cleat for an article of footwear is provided. The cleat includes a disc with opposing faces. One face of the disc includes a shoe attachment element for removably attaching the cleat to the footwear's outsole. A cushioning layer directly engages the second face of the disc and a traction element directly engages the cushioning layer, forming a "sandwich." The traction element provides secure footing when installed in footwear. The cushioning layer affords resilient backing to the traction element, enhancing user comfort. The traction element provides a durable covering for at least a portion of the cushioning layer, extending the life of the cleat.

In another embodiment of the invention, a removable cleat for a shoe is provided. The cleat includes a disc with opposing faces. A shoe attachment element is connected to one face of the disc. At least one traction element directly engages the second face of the disc. The traction element includes cushioning material formed in one or more faces of the traction element. In some embodiments, a face with cushioning material is oriented towards the center of the disc and, in other embodiments, a face with the cushioning material is oriented away from the center of the disc. In further embodiments, the cleat includes a mix of traction elements with each type of face. In yet another embodiment, the cleat includes traction elements with cushioning material embedded into more than one face of the traction element.

In another embodiment of the invention, a removable cleat for a shoe is provided. The cleat includes a disc with opposing faces, with a shoe attachment element connected to one face of the disc. The shoe attachment element removably attaches the cleat to the outsole of the shoe. A cushioning layer includes opposing faces with at least a portion of one face of the cushioning layer directly engaging the surface-facing face of the disc. The cushioning layer further including a debris skirt, such that when the cleat is securely attached to footwear, the debris skirt substantially prevents debris from moving towards the shoe attachment element. At least one traction element directly engages the surface-facing face of the cushioning layer and provides secure footing for the shoe wearer. In some embodiments of the invention, the shape of the debris skirt provides additional cushioning to the traction element, when the debris skirt deflects under pressure from the weight of the wearer. The debris skirt may be made with folds, like an accordion or bellows, to provide such cushioning deflection.

In a further embodiment of the invention, a removable cleat for a shoe is provided. The cleat includes a disc with opposing faces. A shoe attachment element is connected to one face of the disc and a traction element or traction element assembly also attaches mechanically to the disc. This method of attaching traction elements to the cleat disc provides a wider choice of materials for the cleat, than is possible with conventional bonded connections. The mechanical connection between traction element and cleat disc may be provided with a press-fit coupler or a rivet or a connector that rotates to attach the traction element to the disc. The mechanical connector between traction element and disc may be provided as a separable component or may be formed as part of a traction element or traction element assembly. In some embodiments, the traction element is formed with one part of the element attached to the cleat disc and a second part formed as a coupler. The traction element can fold over and mate with a corresponding coupler embedded in the cleat disc. The flex of the folded-over traction element provides a cushioning effect for the wearer.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

Definitions. As used in this description and the accompanying claims, the following terms shall have the meanings indicated, unless the context otherwise requires:

A "shoe" means any outer covering for a foot including, without limitation, athletic footwear, sandals, boots, and slippers.

A "disc" means any object with opposing, generally planar faces. A disc can include concave portions or convex portions or combinations of concave and convex portions. Discs are not limited to circular shapes but may be, for example, elliptical, triangular, rectangular, or even irregular shapes, etc.

In various embodiments of the present invention, a removable footwear cleat comprises a shoe attachment portion, a cushioning layer directly engaging the shoe attachment portion and a traction element assembly, positioned on the cushioning layer. Thus, the cleat forms a "sandwich." The shoe attachment portion includes a disc with opposing faces. One face of the disc includes a shoe attachment element that removably attaches the cleat to a corresponding element (i.e., receptacle) in a shoe outsole. A second face of the disc supports the cushioning layer. When a user steps on a surface wearing a shoe outfitted with these cleats, the resilience (i.e., "give") of the cushioning layer at once both lessens the impact of the traction elements on the ground surface and lessens the reaction force on the user's foot, as transmitted through the shoe's outsole. The user's comfort is thereby enhanced.

Figure 1:
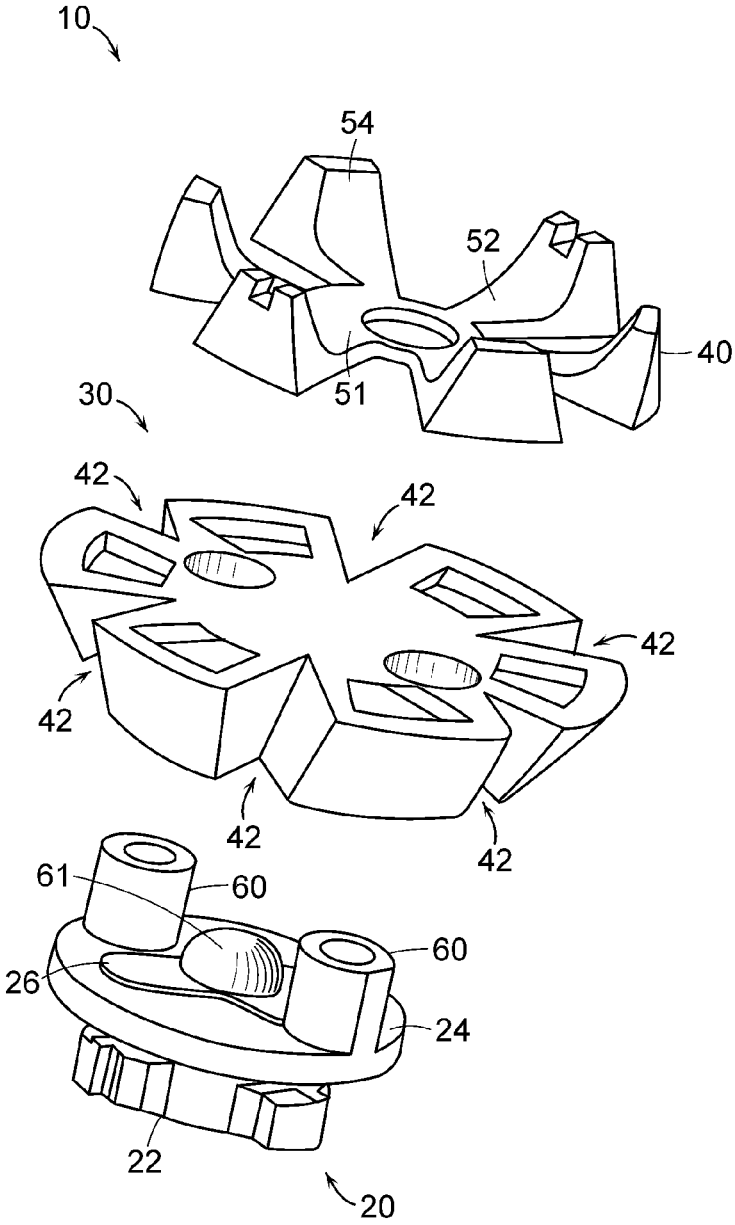
FIG. 1 is an exploded view of a removable cleat for footwear, according to an embodiment of the invention.
Figure 2A:
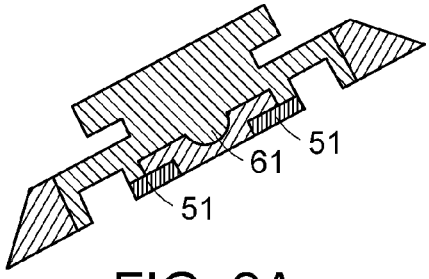
FIGS. 2-2A-2B include several additional views of the cleat of FIG. 1.
Figure 2:
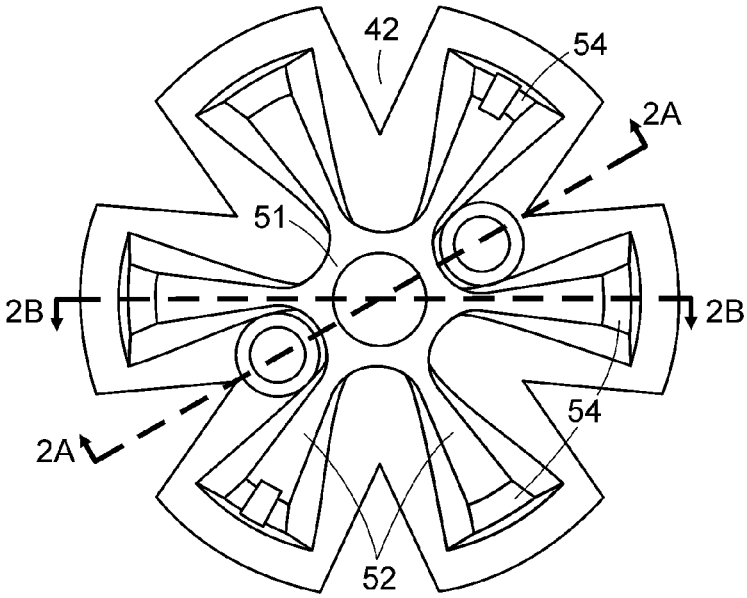
Figure 2B:
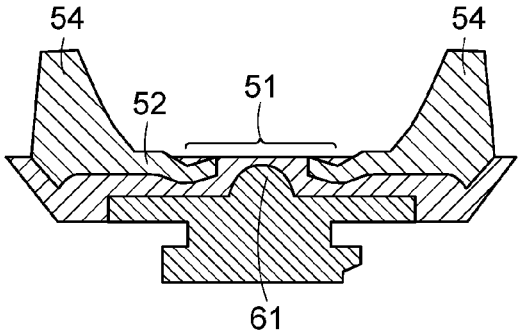

In an embodiment of the invention, as shown in the exploded view of FIG. 1, a removable cleat 10 consists of a "sandwich" comprising a shoe attachment portion 20, a cushioning layer 30 and a traction element assembly 40. The shoe attachment portion 20 supports the cushioning layer 30. The traction element assembly 40 is installed on the surface (or in the surface) of the cushioning layer 30. FIG. 2 shows a plan view of the cleat of FIG. 1 from the top, along with two sectional views.

Referring to FIG. 1, the shoe attachment portion 20 of the cleat includes a disc 24 with opposing faces. A male shoe attachment element 22 is coupled to a first face of the disc 24. The shoe attachment element may be formed according to any design known in the art, such as Macneill Engineering's Q-LOK™ system, which is described in U.S. Pat. No. 5,768,809, which patent is incorporated herein by reference. The second face 26 of the shoe attachment disc 24 includes two or more cleat wrench pin shafts 60, formed typically as hollow cylinders, extending away from the disc face 26. These shafts 60 allow a cleat wrench to attach temporarily to the cleat for removably attaching the cleat to a shoe outsole. The user inserts the prongs of a cleat wrench into the wrench pin shafts and applies torque to the wrench to rotate the cleat. Insertion of the shoe attachment element 22 into a matching receptacle (not shown) in the shoe outsole, followed by rotation of the cleat, attaches the cleat to the outsole. These wrench pin shafts extend through the cushioning layer of the cleat and through the traction element assembly to the surface of the ground-engaging face of the cleat. This construction avoids attaching the cleat wrench to either the traction element assembly or to the cushioning material. The former is likely to twist as torque is applied by the wrench while the latter is too soft to transfer torque to the shoe attachment element of the cleat effectively.

In some embodiments of the invention, the second face of the disc 26 (i.e. ground-facing face) includes one or more raised portions 61. This raised portion 61 is located below the ground-engaging surface of the cleat, when the cleat is complete. In preferred embodiments, this raised portion may be attached to the center of the ground-facing disc face 26. This raised portion can serve as a wear indicator. When the ground-engaging surface (i.e. traction element assembly 40) of the cleat has worn away sufficiently, the wear indicator is exposed as a sign to the user that the cleat should be replaced. The color of the wear indicator may contrast with the color of traction elements to provide a visible sign to the user that the ground-engaging surface of the cleat has worn away.

The ground-facing face 26 of the cleat disc 24 supports the cushioning layer 30 of the cleat 10. The cushioning layer provides resilience or "bounce" to the cleat. The cushioning layer may be made of plastic or rubber or another compressible material. In specific embodiments of the invention, the cushioning layer material preferably ranges in durometer from Shore 10A to Shore 50A. In some embodiments, the cushioning layer may take on a regular, convex shape. (See FIG. 5, cushioning layer 40, for example, where the cushioning layer is formed as a disc). In other embodiments, the cushioning layer may include one or more cutouts or notches. (See, for example, FIG. 1 where cushioning layer 30 includes six regularly spaced cutouts 42.) The cushioning material can expand into the space formed by these cutouts 42 as the traction elements above the cushioning layer make ground contact, compressing the cushioning layer. The resilience or bounce provided by the cushioning layer to the shoe attachment element and the traction elements is thereby enhanced.

The traction element assembly 40 of the cleat engages the ground surface, providing traction for the user. The traction element assembly of the cleat may be formed with traction elements in a variety of shapes and sizes and with various materials. The traction element assembly 40 provides protection for the relatively softer cushioning layer 30, as the cleat contacts the ground surface. Note that the term "traction element assembly" does not imply that all of the traction elements are necessarily connected in each embodiment of the invention. Some, all or none of the elements may be connected together in a traction element assembly.

In the embodiment of the invention shown in FIGS. 1 and 2, the traction element assembly consists of six traction teeth 54 connected to a central hub 51 by individual spokes 52. This traction element assembly structure allows each traction tooth (and spoke) to flex independently of each other tooth and spoke when contacting the ground surface. The cushioning layer supports and cushions each traction tooth independently of each other traction tooth. The cushioning layer provides the restoring force to return the traction tooth and spoke to its original position, as a cleat traction tooth leaves the ground surface as the wearer walks. The cushioning layer will flex into the space between the spokes as the spokes move. The traction teeth at the ends of the spokes (which spokes are also known as flex beams) are the primary traction points for the cleat. In various specific embodiments of the invention, these teeth can be of any shape (conical, square, pyramidal, frusto-conical, etc), of any length or height, and may have any shape tip (pointed, blunt, domed, slanted inward, slanted outward, etc). The number of teeth at the end of a spoke is variable and the number of spokes connected to a disc may number more or less than six. The axis of each tooth is preferably oriented at a maximum of 90 degrees to the plane of the cleat (i.e., to the plane of the outsole when installed), or may be substantially less than 90 degrees (e.g., angled toward the center of the disc). The hub at the center of the traction element assembly may be solid or the hub may have an opening to accommodate a wear indicator or to allow material in the cushioning layer to flex through the opening. In a preferred embodiment of the invention, a plurality of such cleats is provided on a shoe outsole. The independent flexing of the traction elements within a cleat and across the plurality of cleats supplies traction that adapts well to uneven surfaces.

In embodiments of the invention, the durometer of the traction elements ranges preferably from about Shore 60A to about Shore 98A. In specific embodiments of the invention, the traction elements are formed from a thermoplastic material, such as polyurethane. In some embodiments of the invention, the traction elements are each similar in construction and arranged in a symmetrical pattern around the perimeter of the cushioning layer. In other embodiments, the traction elements may differ in size, shape, and/or material and may be placed asymmetrically with respect to the perimeter of the cushioning layer. In each embodiment, the cushioning material provides resilient backing for the harder traction element assembly positioned on it when the user puts weight on the cleat through the shoe outsole. The disc, being formed of a material that is less resilient than the cushioning layer, provides support for the cushioning layer. The traction element assembly may be formed to fully cover the cushioning layer, providing a high level of protection for the cushioning layer from surface contact, or may cover only a portion of the cushioning layer. As described above, the cushioning layer may include notches that allow the cushioning material to expand into the notches as the traction elements apply pressure to the cushioning layer. These notches can also allow the traction elements to twist from side-to-side as the cushioning material flexes to fill the notches. This traction element twisting action can provide for enhanced traction on uneven surfaces.

In preferred embodiments of the invention, the cushioning layer material and the traction element assembly material are matched so that the difference in durometer between the cushioning layer and the traction element assembly ranges from about 20 to about 70 points on the Shore durometer scale. In various embodiments of the invention, the materials may be tailored for factors such as the characteristics of the shoe wearer or the characteristics of the ground surface. For example, a heavier player may be provided with a cleat with a cushioning layer material that is (relatively) harder, coupled with a correspondingly harder traction element material. A smaller or lighter weight player may be provided a cleat with corresponding softer elements. As a second example, for play on dry, hard, firm ground a cleat with a larger spread between the hardness of the cushioning layer and the traction element assembly may be provided. For play on wet or soft ground, a cleat with a smaller spread between the hardness of the elements may be advantageously employed.

Figure 4:
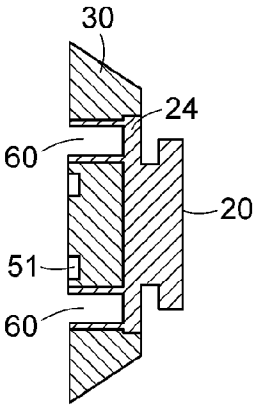
FIG. 4 is another sectional view of the cleat of FIG. 3.
Figure 5:
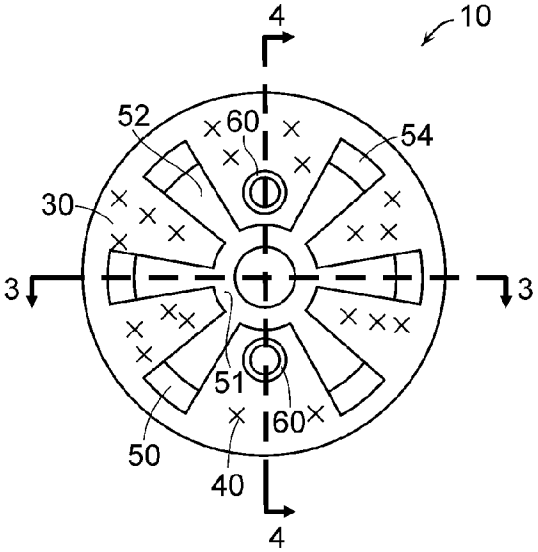
FIG. 5 shows the ground contacting face of the cleat of FIG. 3.
Figure 3:
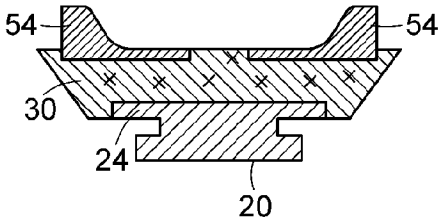
FIG. 3 is a sectional view of a removable cleat for an alternative embodiment of the invention.

FIGS. 3-5 show another illustrative embodiment of the invention. This embodiment is similar to the embodiment shown in FIGS. 1-2, except that the cushioning layer is formed as a disc without notches. (A common numbering scheme is used for the features in FIGS. 3-5 and in FIGS. 1-2).

Figure 6B:
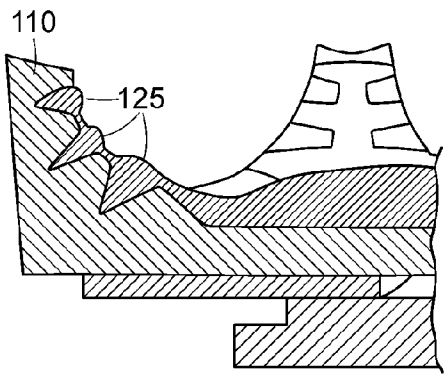
FIGS. 6A-6B illustrate an alternative embodiment of the invention that includes cushioning material embedded in traction elements.
Figure 6C:
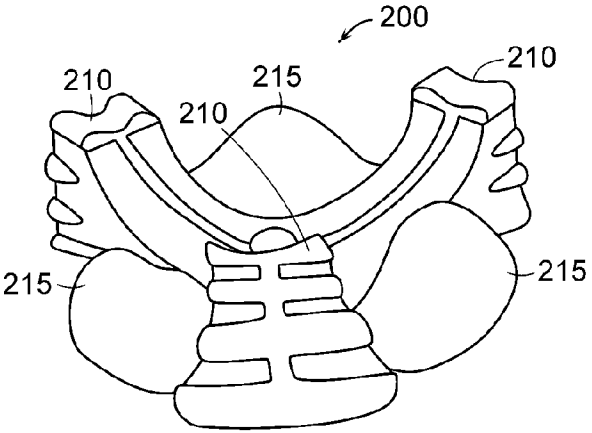
FIGS. 6C-6D illustrate another embodiment of the invention that includes cushioning material embedded in traction elements.
Figure 6A:
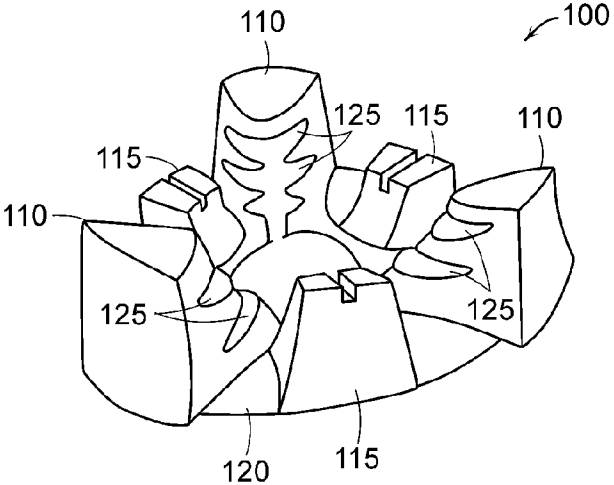

In another embodiment of the invention, as shown in FIGS. 6A and 6B, a cleat includes traction elements (110, 115) connected directly to the second face (ground-engaging face) 120 of a shoe attachment portion disc 120. FIG. 6A is a perspective view of the ground-engaging face of the cleat. The cushioning material 125 is inserted into slots formed in a face of traction elements 110. This face of the traction element faces the center of the ground-facing face 120 of the disc. FIG. 6B shows a traction element 110 in cross section with the cushioning material 125 on the traction element face. The elastic nature of the cushioning material provides a restoring force as a traction tooth compresses the cushioning material under the weight of a user. Likewise, if the traction element 110 is twisted away from the center of the cleat disc, the elasticity of the cushioning material will provide a restoring force, tending to return the traction element to its upright position.

Figure 6D:
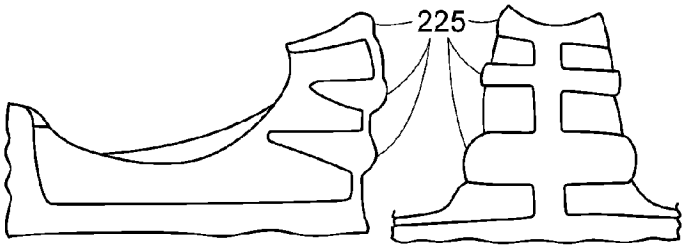

In a further related embodiment, as shown in FIGS. 6C and 6D, a cleat 200 includes traction elements (210, 215) connected directly to the second face (ground-facing face) of a shoe attachment portion disc (not shown). Traction elements 210 include cushioning material 225 inserted into slots formed in the face of traction elements 210, as shown in FIG. 6D. This face of the traction element faces away from the center of the ground-facing face of the cleat disc. The elastic nature of the cushioning material provides a restoring force as the traction teeth compress the cushioning material under the weight of a user. Likewise, if the traction element 210 is twisted inward toward the center of the cleat, the elasticity of the cushioning material will provide a restoring force, tending to return the traction element to its original orientation.

In other embodiments of the invention, a traction element may be provided with the cushioning material embedded into any face of the traction element. Further, a traction element may have cushioning material embedded into more than one face of the element. For example, a traction element may have cushioning material embedded into two faces of the element with one face oriented towards the center of the cleat disc and another face oriented away from the center of the disc. The traction elements for a cleat may be all of a common type or may include any mix and placement of traction elements with different patterns of cushioning material in traction element faces.

Debris Skirt

In other embodiments of the invention, a removable footwear cleat includes a cushioning layer with a debris skirt. The debris skirt prevents dirt, grass and other material from entering and clogging the space between the cleat and outsole of a shoe. The cleat comprises a shoe attachment portion; a cushioning layer directly engaging the shoe attachment portion; and a traction element assembly, positioned on the cushioning layer. The shoe attachment portion includes a disc with opposing faces. One face of the disc includes a shoe attachment element that removably attaches the cleat to a corresponding element (e.g., receptacle) in a shoe outsole. The opposing face of the disc supports the cushioning layer. The perimeter of the cushioning layer includes a debris skirt. When installed on the shoe, the skirt extends toward the outsole of the shoe. When the cleat is fully engaged with the receptacle, the skirt contacts the outsole, forming a barrier to debris. The structure of the cushioning layer between the skirt and the second face of the disc can allow the debris skirt to deflect when pressure from ground contact forces the traction element into the cushioning layer. Such debris skirt deflection increases the resiliency of the cushioning layer at the layer's perimeter, enhancing user comfort and protection of the turf surface.

Figure 7B:
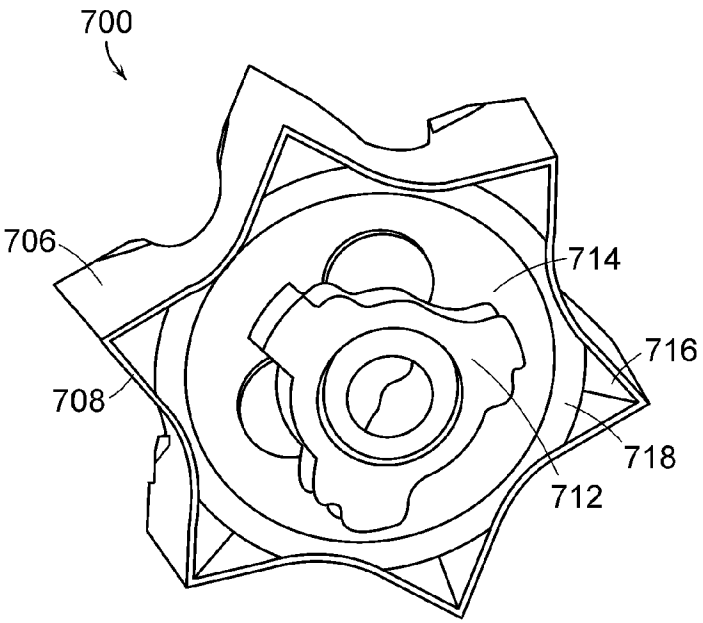
FIG. 7B shows a view from the shoe-attachment side of the cleat of FIG. 7A.
Figure 7A:
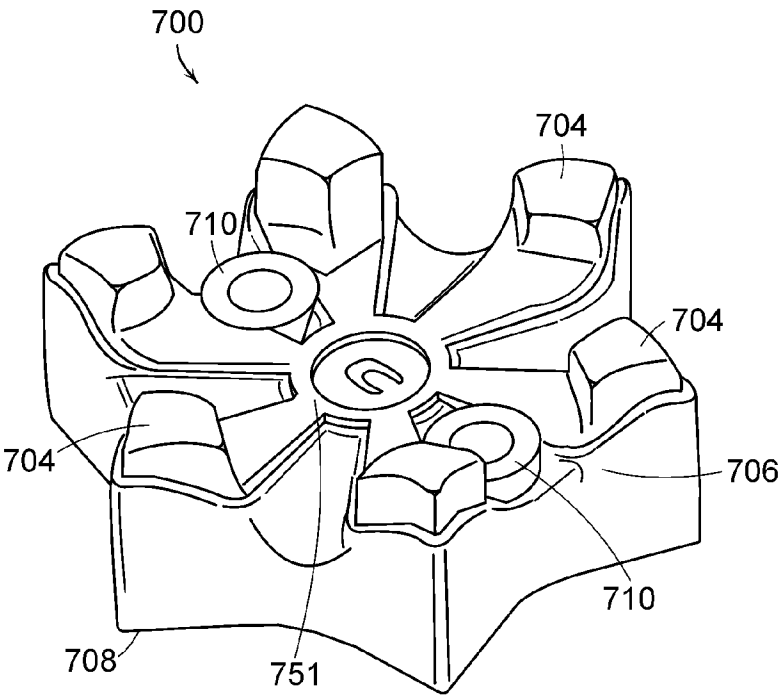
FIGS. 7A shows a view of the ground-engaging face of a cleat with a debris skirt, in an embodiment of the invention.
Figure 8:
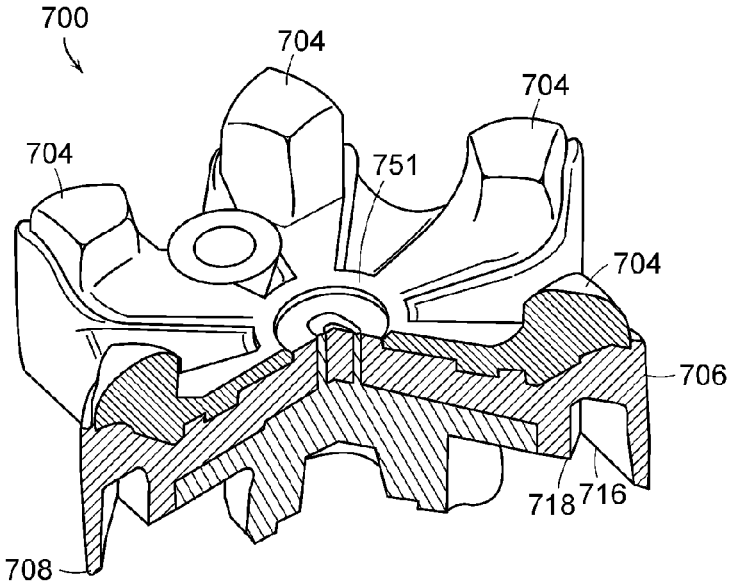
FIG. 8 shows a cutaway view of a section of the cleat of FIG. 7A.
Figure 9A:
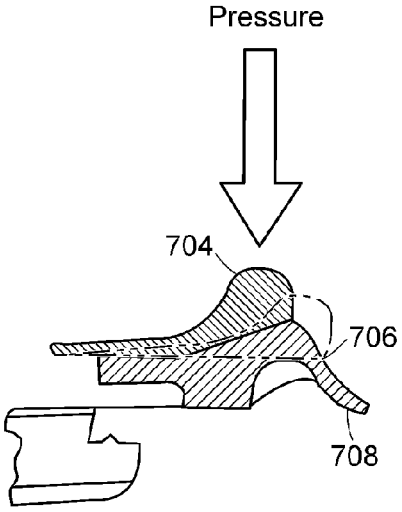
FIGS. 9A-9B illustrate the reaction of the debris skirt to pressure from the adjacent traction element for the cleat of FIG. 7A.
Figure 9B:
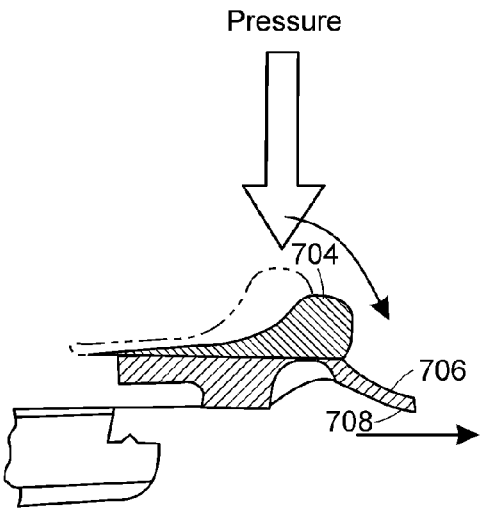

An example of a cleat 700 with a debris skirt is shown in FIG. 7, according to an embodiment of the invention. FIG. 7A shows a perspective view of the ground engaging face of the cleat 700. A plurality of traction elements 704 are connected via spokes to a center hub 751, forming a traction element assembly. The traction element assembly engages a cushioning layer 706. The cushioning layer includes a skirt 708 which extends upwards and typically contacts the shoe outsole, when the cleat is installed in the shoe. A cleat wrench can engage pin shafts 710 in the ground engaging face of the cleat to install the cleat into the shoe. FIG. 7B shows a perspective view of the shoe attachment portion of the cleat 700. The shoe attachment portion includes a disc 714 with opposing faces, one face of which is visible in FIG. 7B, and a male shoe attachment element 712. The shoe attachment element 712 is inserted into a receptacle in the shoe outsole and rotated to attach the cleat to the shoe. The shoe attachment face of the disc 714 includes a perimeter 718, which, in this embodiment, is generally circular. The cushioning layer 706 includes a hollow portion 716 between the disc perimeter 718 and debris skirt 708. FIG. 8 shows a cutaway perspective view of the structure of the cleat 700 from the ground engaging side of the cleat. As shown in FIG. 9, when pressure is applied to a traction element 704 by contact with the ground surface, the debris skirt bends upward toward the shoe. The hollow 716 behind the debris skirt allows the portion of the skirt which contacts the outsole to slide outwardly from the disc's center. The debris skirt at once prevents debris from migrating towards the shoe attachment element of the cleat and provides additional cushioning to the traction element as the bottom of the skirt slides outwardly.

Figure 11:
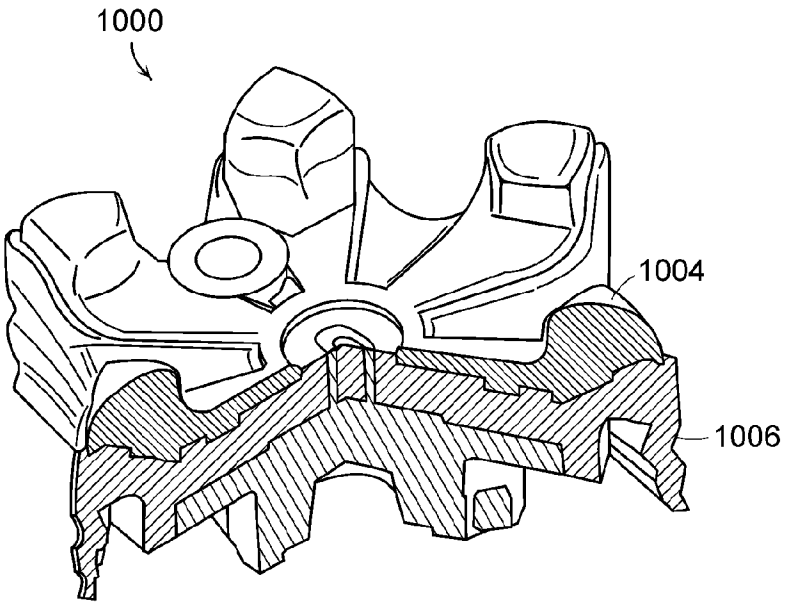
FIG. 11 shows a cutaway view of a section of the cleat of FIG. 10.
Figure 10:
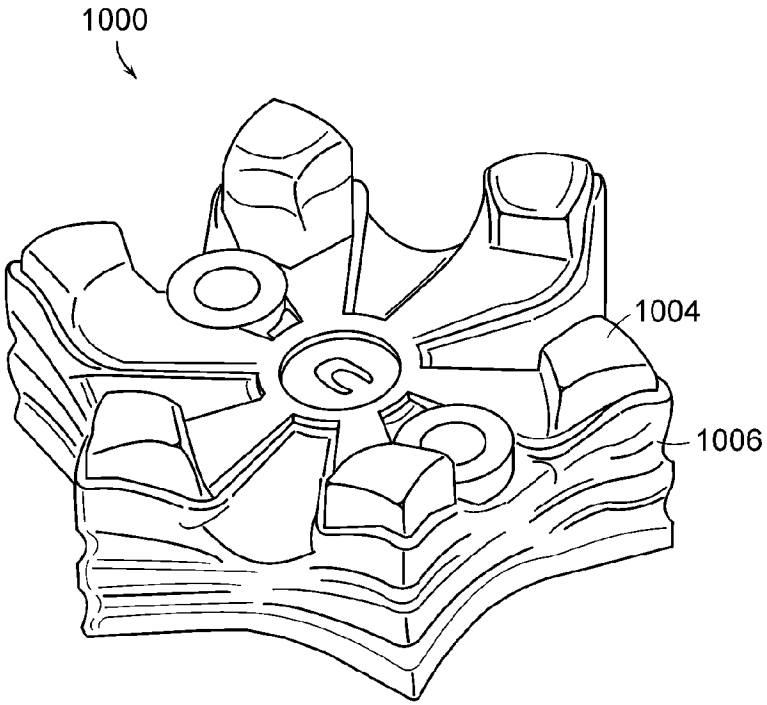
FIG. 10 shows a cleat with a debris skirt that folds, according to an embodiment of the invention.

In a related specific embodiment of the invention, the outer perimeter 1006 of the cushioning layer of a cleat 1000 forming the debris skirt may include folds, like an accordion or bellows, as shown in FIG. 10. As illustrated in FIG. 11, the folds allow the outer face of the cushioning layer to resiliently deflect upwards towards the shoe when pressure is applied to a traction element 1004. The folds permit the face of the cushioning layer to bend upward towards the outsole without deflecting substantially outward from the center of the disc.

Figure 12B:
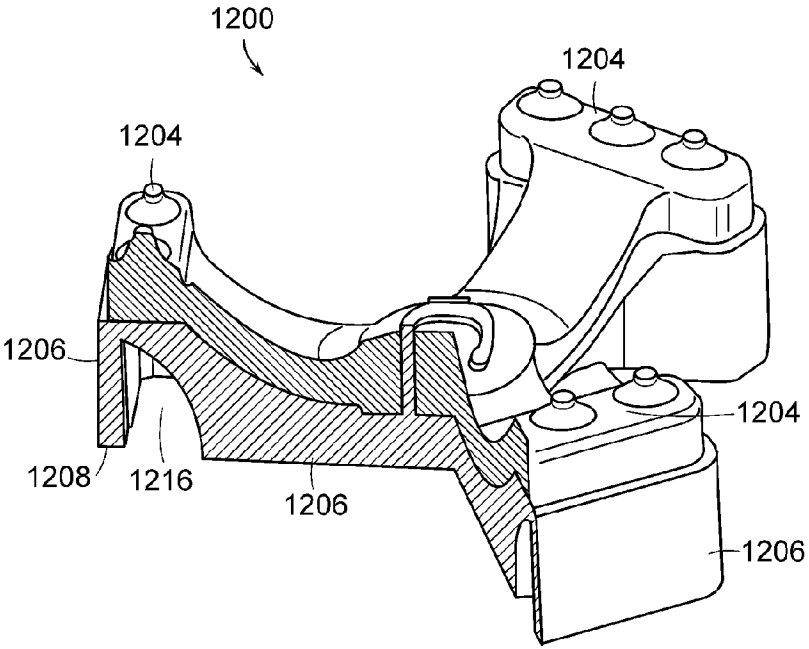
FIG. 12B shows a cutaway view of a section of the cleat of FIG. 12A.
Figure 12A:
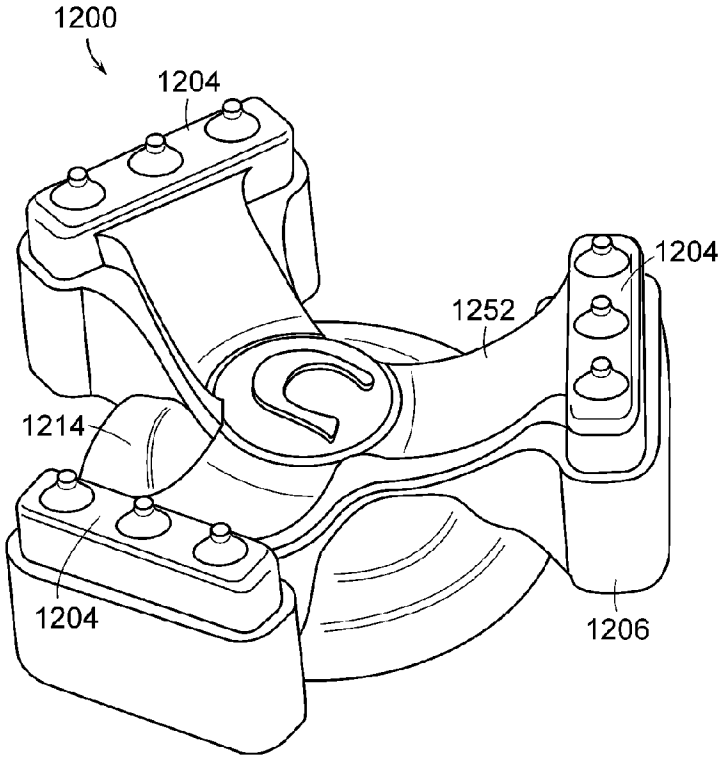
FIG. 12A shows a cleat with a hollow cushioning layer supporting a traction element, according to an embodiment of the invention.

In another specific embodiment of the invention, as shown in FIG. 12, the cushioning layer of the cleat 1200 may include cutouts such that the cushioning layer is not rotationally symmetrical about the axis of the shoe attachment element (not shown) of the disc 1214. As described previously, this arrangement allows the cushioning material to expand into the cutouts as pressure is applied to the traction elements 1204 and spokes 1252 of the traction element assembly, enhancing the cushioning effect. A cavity 1216 is provided behind the outer perimeter 1208 of the cushioning layer 1206. This cavity can trap air which provides an additional cushioning effect as pressure is applied to the traction element above the cavity. The air trapped in the cavity 1216 by the outsole of the shoe can escape relatively slowly providing an additional measure of resiliency for the traction element assembly. While three cutouts (and spokes) are shown for this embodiment, any number of spokes and cutouts can be employed in various embodiments of the invention.

Mechanical Attachment of Traction Elements to Cleat

In other embodiments of the invention, traction elements or a traction element assembly are attached mechanically to the shoe attachment portion of a cleat. The shoe attachment portion of the cleat comprises a disc with opposing faces attached to a shoe attachment element. One face of the disc supports a cushioning layer between the traction element assembly and the disc. Mechanical attachment of the traction elements to the shoe attachment portion of the cleat allows a wider range of materials to be used for cleat components than are possible with a bonded coupling.

The traction element assembly may be coupled to the shoe attachment portion in one of several ways. First, the traction element assembly may be fabricated as a structure separate from the shoe attachment portion. The assembly may then couple mechanically to the shoe attachment portion with a fastener. The assembly may include an integral fastener which attaches to the cleat or a separate fastener, such as a rivet, may couple the traction element assembly to the cleat. Second, traction elements forming the assembly may be fabricated as part of the shoe attachment portion disc, typically on the disc's perimeter. These elements can then fold over towards the center of the disc. For example, the traction elements can attach to the face of the disc with a fastener, such as a rivet, or a portion of the traction element can serve as a coupling element (male or female) mating to the complementary element on the face of the disc.

Figure 13:
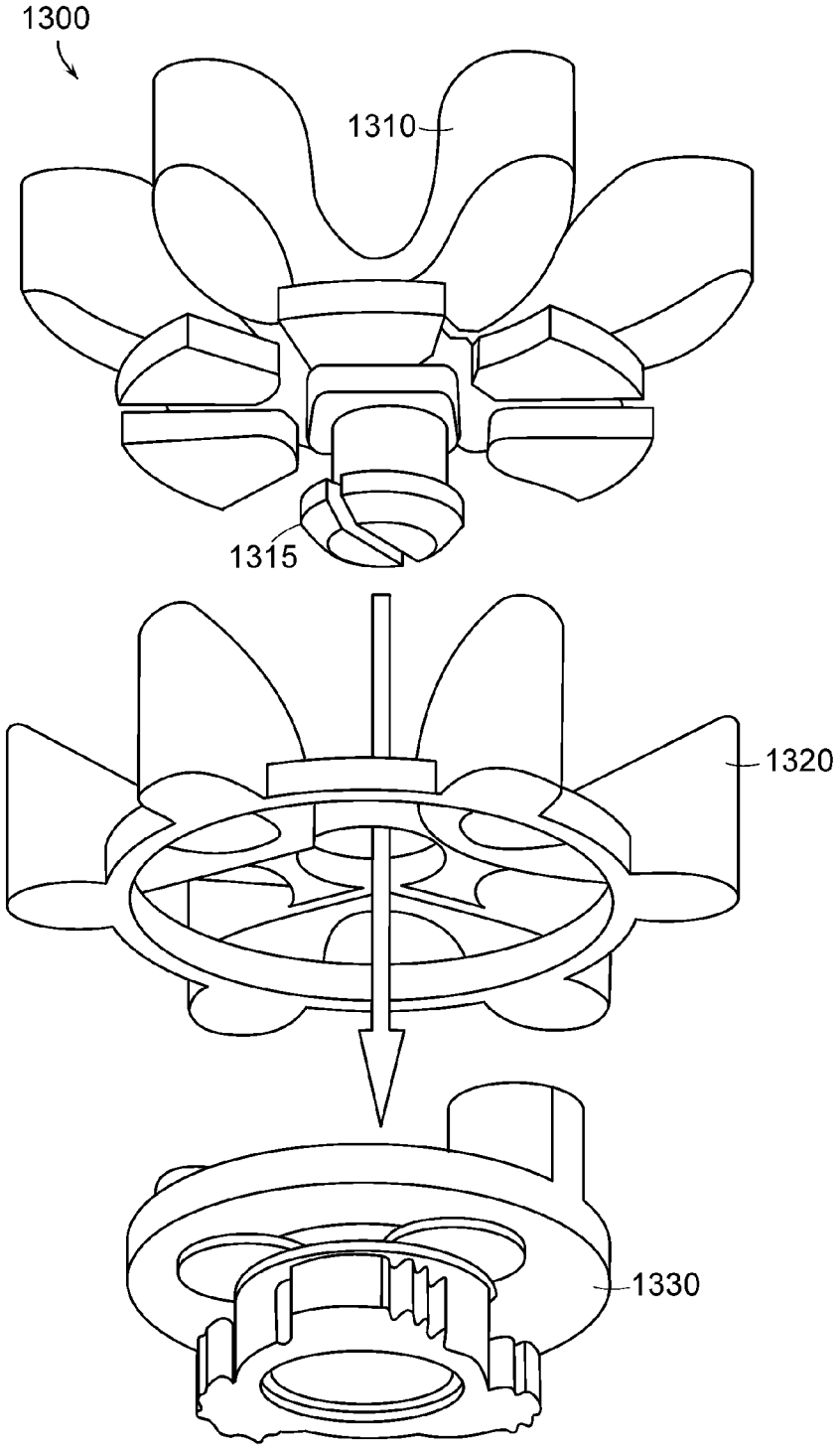
FIG. 13 shows an exploded view of a cleat with a traction element with an integral mechanical coupler, according to an embodiment of the invention.
Figure 15:
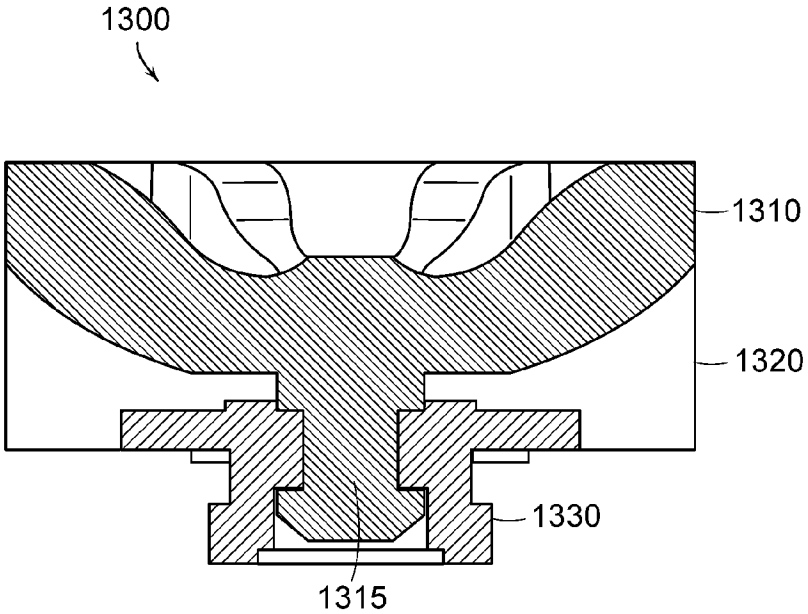
FIG. 15 shows the cleat of FIG. 13 in a cutaway side view, assembled.
Figure 14:
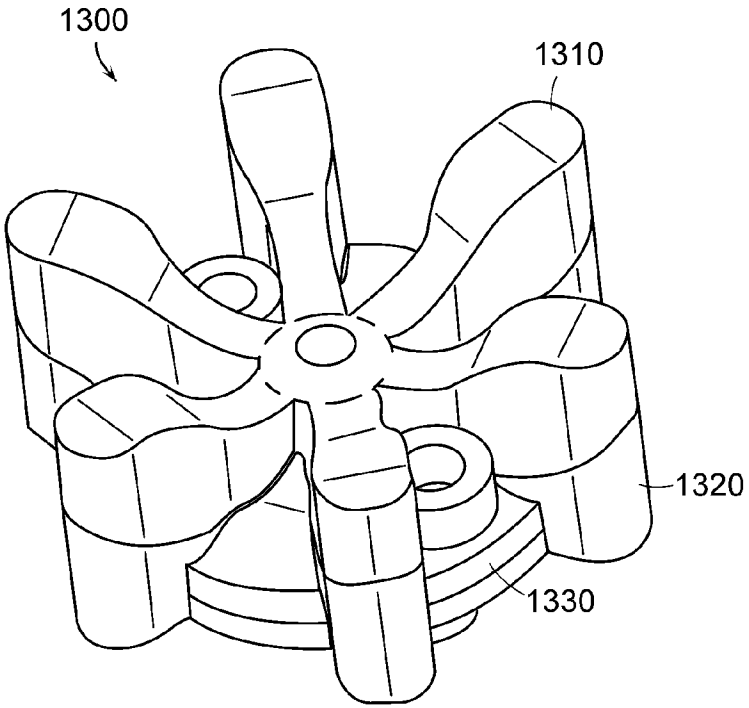
FIG. 14 shows a view of the cleat of FIG. 13, assembled.

An illustrative embodiment of this aspect of the invention is shown in FIGS. 13 to 15. FIG. 13 is an exploded view of a cleat 1300. The traction element assembly 1310 couples a cushioning layer 1320 to the shoe attachment portion 1330 of the cleat. The traction element assembly 1310 includes an integral snap-fit coupler 1315. To assemble the cleat, the cushioning layer 1320 is placed on the shoe attachment portion 1330 or bonded to it. The snap-fit coupler of the traction element assembly 1310 may then be inserted through the hole in the cushioning layer and into the hole in the center of the shoe attachment portion of the cleat. Thus, a sandwich of the three structures is formed. In other embodiments of the invention, a variety of coupler element types may be used, as are known in the art. FIG. 14 shows a perspective view of the assembled cleat 1300 and FIG. 15 shows a cross-sectional view of the cleat. In a specific embodiment of the invention, the integral coupler can be replaced with a separate rivet that fits through the traction element assembly and attaches the traction element assembly 1310 to the disc 1330.

Figure 17:
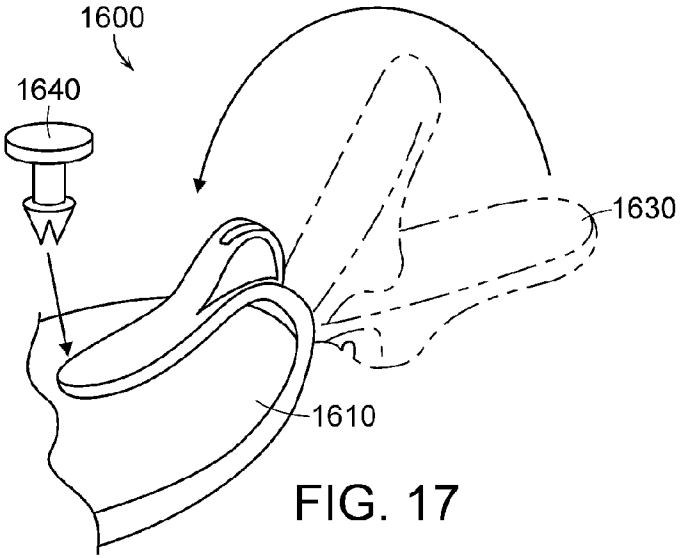
FIG. 17 shows a procedure for assembling the cleat of FIG. 16.
Figure 16:
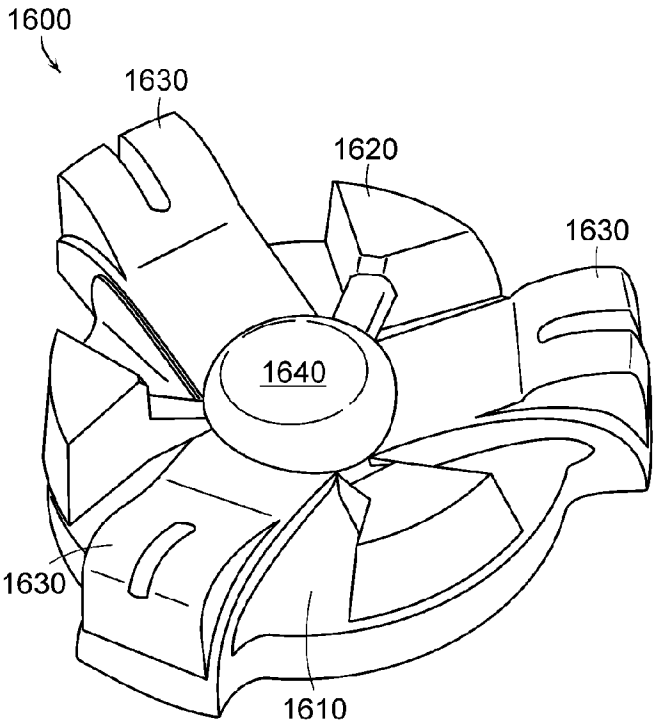
FIG. 16 shows a cleat with a rivet fastener holding folding traction elements to a cleat disc according to an embodiment of the invention.

In another illustrative embodiment of the invention, as shown in FIG. 16, a separate fastener (in this case, a rivet) connects one end of each traction element to the shoe attachment portion of a cleat 1600. The cleat includes a disc 1610 with opposing faces, a traction element array 1620, one or more fold-over traction elements 1630, and a rivet 1640. The traction element array 1620 engages the ground-facing face of the disc 1610. The array 1620 may be bonded to this face of the disc. As shown in FIG. 17, each traction element 1630 is attached on one end to the perimeter of the disc 1610, with the other end of the traction element free to move. Each traction element 1630 can be folded over towards the center of the disc 1610. A rivet 1640 can then be inserted into the center of the disc 1610. This rivet attaches the free end of each traction element 1630 to the face of the disc. FIG. 17 illustrates the operation of folding over the traction element 1630 and attaching the element to the face of the disc 1610 with a rivet 1640. The flex of the traction elements 1630 when it is folded over to the center of the disc advantageously enhances the wearer's comfort as the cleat impacts the ground surface. In some embodiments of the invention, cushioning material may be bonded to the disc face over which the traction elements fold, providing additional resiliency to the flex of the folded-over traction element.

Figure 18:
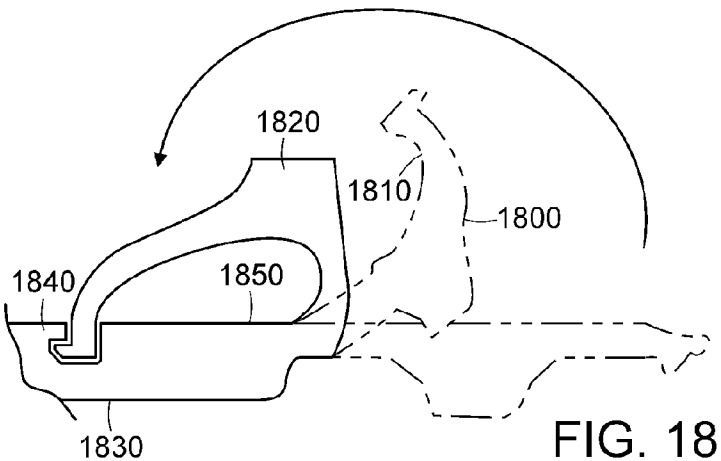
FIG. 18 shows an alternative approach to fastening folding traction elements to a cleat disc in an embodiment of the invention.

In another embodiment of this aspect of the invention, as shown in FIG. 18, each traction element 1800 includes a coupling element 1810 on the traction element's free end. The traction element 1800 is folded over and the coupling element 1810 is inserted into a corresponding coupling element 1840 in the ground-facing face of the disc 1830. The traction element 1800 forms a cavity 1850 when the element is folded over and coupled to the ground-facing face of the disc. Cushioning material may be placed on the face of the disc so that this material fits into the cavity 1850 formed by the folded-over traction element 1800. When pressure from the outsole of the shoe forces the traction surface 1820 of the traction element 1800 into the turf as the wearer steps, the flex of the traction element and the resiliency of the cushioning layer advantageously enhance the wearer's comfort. While a male coupling element 1810 is shown at the end of the traction element 1800, in specific embodiments of the invention, the traction element may include a female coupling element at its free end with a corresponding male coupling element embedded in the disc.

In specific embodiments of the invention, any of the above cleat embodiments may include one or more of the following variations:

The shoe attachment element structure may employ any structure known in the art, such as a threaded stud, a Q-LOK™ structure, a TRI-LOK™ structure, etc.

The durometer of the traction elements may range from about Shore 60A to about Shore 98A.

The cushioning layer material may range in durometer from about Shore 10A to about Shore 50A and may comprise plastic or rubber or another compressible material.

The cushioning layer material and the traction element or traction element assembly material can be matched so that the difference in durometer between the cushioning layer and the traction element assembly ranges from about 20 to about 70 points on the Shore durometer scale.

The cleat materials may be tailored for factors such as the characteristics of the shoe wearer or the characteristics of the ground surface. For example, a heavier player may be provided with a cleat with a cushioning layer material that is (relatively) harder, coupled with a correspondingly harder traction element material. A smaller or lighter weight player may be provided a cleat with corresponding softer elements. As a second example, for play on dry, hard, firm ground a cleat with a larger spread between the hardness of the cushioning layer and the traction element assembly may be provided. For play on wet or soft ground, a cleat with a smaller spread between the hardness of the elements may be advantageously employed.

Cleat Fabrication

The cleats described above may be fabricated using conventional techniques, as are known in the art, such as injection molding. In one preferred method of fabricating a cleat, a two-step process is employed. First, one element, either the traction element or the shoe attachment portion of the cleat, is molded. Then, this first element is used as an "insert" in a two-color and two-injection plastic molding machine. This second operation molds two elements, in two different colors, and bonds the three elements together. In practice, the single "insert element" may be loaded into the second machine either by hand, or automatically by a "pick and place" robotic arm. In a second preferred method, the traction element and the attachment element are made separately in injection plastic molding machines, as individual pieces. Then, these separate pieces are loaded as inserts into a second machine. In the second machine, the third material is injected into the middle, bonding the cleat together.

Similarly, it is of course apparent that the present invention is not limited to the detailed description set forth above. Various changes and modifications of this invention as described will be apparent to those skilled in the art without departing from the spirit and scope of this invention as defined in the appended clauses.

We claim:

1. A removable cleat for a shoe, the cleat comprising:
a disc including opposing first and second faces;
a shoe attachment element attached to the first face of the disc; and
a plurality of traction elements directly engaging the second face of disc, the second face of the disc including a center, wherein at least two of the traction elements include cushioning material inserted into slots formed in a face of the at least two fraction elements.

2. The cleat according to claim 1, wherein the face of the at least one traction element including cushioning material generally faces the center of the disc.

3. The cleat according to claim 1, wherein the face of the at least one traction element that includes cushioning material generally faces away from the center of the disc.

4. The cleat according to claim 2, wherein the slots on each of the at least two traction elements connect with each other at a midpoint of each slot such that the cushioning material on each of the at least two traction elements is integrally formed.

5. The cleat according to claim 1, wherein the slots on each of the at least two traction elements connect with each other at a midpoint of each slot such that the cushioning material on each of the at least two traction elements is integrally formed.

6. The cleat according to claim 1, wherein at least two slots, one on each of the at least two traction elements, connect with each other at a midpoint of the at least two traction elements such that the cushioning material among the at least two traction elements is integrally formed.

7. The cleat according to claim 5, wherein at least two slots, one on each of the at least two traction elements, connect with each other at a midpoint of the at least two traction elements such that the cushioning material among the at least two traction elements is integrally formed.

8. The cleat according to claim 2, further includes a face facing away from the center of the disc and comprising cushioning material.

9. A removable cleat for a shoe, the cleat comprising:
a disc including opposing first and second faces;
a shoe attachment element attached to the first face of the disc; and
at least one traction element directly engaging the second face of disc, the second face of the disc including a center,
wherein the traction element includes cushioning material inserted into slots formed in a face of the at least one traction element and the face of the at least one traction element including cushioning material generally faces the center of the disc.

10. A removable cleat for a shoe, the cleat comprising:
a disc including opposing first and second faces;
a shoe attachment element attached to the first face of the disc; and
at least one traction element directly engaging the second face of disc, the second face of the disc including a center, wherein the traction element includes cushioning material inserted into slots formed in a face of the at least one traction element, and wherein the slots connect with each other at a midpoint of each slot such that the cushioning material on the at least one traction element is integrally formed.

11. The cleat according to claim 10, wherein the face of the at least one traction element including cushioning material generally faces the center of the disc.

12. The cleat according to claim 10, wherein the face of the at least one traction element that includes cushioning material generally faces away from the center of the disc.

13. The cleat according to claim 11, further includes a face facing away from the center of the disc and comprising cushioning material.

* * * * *